US007018958B2

(12) United States Patent
Arrowsmith et al.

(10) Patent No.: US 7,018,958 B2
(45) **Date of Patent: *Mar. 28, 2006**

(54) LUBRICATING OIL COMPOSITIONS

(75) Inventors: Stephen Arrowsmith, Oxfordshire (GB); Nancy Z. Diggs, Westfield, NJ (US); Andrew J. D. Ritchie, Chatham, NJ (US); Jorge O. Pain, Jersey City, NJ (US)

(73) Assignee: Infineum International Limited, (GB)

( * ) Notice: Subject to any disclaimer, the term of this patent is extended or adjusted under 35 U.S.C. 154(b) by 215 days.

This patent is subject to a terminal disclaimer.

(21) Appl. No.: 10/277,295

(22) Filed: Oct. 22, 2002

(65) Prior Publication Data

US 2004/0077506 A1 Apr. 22, 2004

(51) Int. Cl.
*C10M 141/12* (2006.01)

(52) U.S. Cl. ..... 508/185; 508/370; 508/378; 508/584; 123/1 A

(58) Field of Classification Search ..... 508/185
See application file for complete search history.

(56) References Cited

U.S. PATENT DOCUMENTS

| | | | | |
|---|---|---|---|---|
| 5,719,107 | A * | 2/1998 | Outten et al. | 508/185 |
| 5,817,605 | A * | 10/1998 | Papay | 508/187 |
| 6,004,910 | A * | 12/1999 | Bloch et al. | 508/294 |
| 6,423,670 | B1 * | 7/2002 | Locke et al. | 508/192 |
| 6,451,745 | B1 * | 9/2002 | Ward | 508/192 |
| 6,610,637 | B1 * | 8/2003 | Curtis et al. | 508/578 |
| 6,720,293 | B1 * | 4/2004 | Bovington et al. | 508/192 |
| 6,730,638 | B1 * | 5/2004 | Farng et al. | 508/194 |
| 6,777,378 | B1 * | 8/2004 | Abraham et al. | 508/185 |
| 6,783,561 | B1 * | 8/2004 | Erdemir | 44/314 |
| 2001/0036906 | A1 | 11/2001 | Locke et al. | 508/192 |
| 2002/0098990 | A1 | 7/2002 | Nakazato et al. | 508/322 |

FOREIGN PATENT DOCUMENTS

EP 1 104 800 A2 6/2001

* cited by examiner

*Primary Examiner*—Ellen M. McAvoy

(57) ABSTRACT

A lubricating oil composition having a total base number of at least about 8, comprising a major amount of oil of lubricating viscosity; an amount of one or more dihydrocarbyl dithiophosphate metal salt introducing into the lubricating oil composition no more than 0.06 wt. % of phosphorus; at least 1.2 wt. % of hindered phenol antioxidant; and boron, and/or a boron-containing compound or compounds in an amount providing the lubricating oil composition with at least 200 ppm by weight of boron, all weight percentages being based on the total weight of the lubricating oil composition.

10 Claims, No Drawings

LUBRICATING OIL COMPOSITIONS

The present invention relates to lubricating oil compositions. More specifically, the present invention is directed to lubricating oil compositions for heavy duty diesel engines that meet API-CI-4 specifications while simultaneously providing improved compatibility with catalytic after-treatment devices, specifically after-treatment devices containing oxidation and/or reduction catalysts.

BACKGROUND OF THE INVENTION

Environmental concerns have led to continued efforts to reduce the CO, hydrocarbon and nitrogen oxide ($NO_x$) emissions of compression ignited (diesel) internal combustion engines. To meet the latest and future standards heavy duty diesel (HDD) original equipment manufacturers (OEMs) rely on one of two technologies, or a combination thereof. One method used to reduce the emissions of diesel engines is known as exhaust gas recirculation or EGR. EGR reduces $NO_x$ emissions by introducing non-combustible components (exhaust gas) into the incoming air-fuel charge introduced into the engine combustion chamber. This reduces peak flame temperature and $NO_x$ generation. In addition to the simple dilution effect of the EGR, an even greater reduction in $NO_x$ emission is achieved by cooling the exhaust gas before it is returned to the engine. The cooler intake charge allows better filling of the cylinder, and thus, improved power generation. In addition, because the EGR components have higher specific heat values than the incoming air and fuel mixture, the EGR gas further cools the combustion mixture leading to greater power generation and better fuel economy at a fixed $NO_x$ generation level.

EGR equipped engines, particularly cooled EGR equipped engines create a harsh environment for lubricating oil compositions due to greater levels of $NO_x$ and sulfur oxide ($SO_x$)-based acids (the latter formed from sulfur introduced primarily by combustion of diesel fuel) and particulate matter that circulates through such engines. The API-CI-4 oil specification was established specifically for lubricating oil compositions for use in cooled EGR equipped HDD engines.

The other major technology being relied on to reduce HDD engine emissions, as used specifically in "ACERT"-type engines manufactured by Caterpillar Inc. (USA), involves adjusting engine timing to provide an early close of the engine exhaust valve; use of a pilot fuel injector(s) upstream of the main fuel injectors to reduce $NO_x$ generation; rate shaping of combustion to reduce the peak combustion temperature and reduce $NO_x$ generation; forcing an excess of air into the combustion chamber (by use, for example, of one or more turbochargers) to provide the required power output, and the catalytic after-treatment devices, such as devices containing oxidation catalysts to reduce levels of unburned hydrocarbons, carbon monoxide, nitrogen oxide and the soluble organic fraction of particulate matter in the engine exhaust gas. Such oxidation catalysts can become poisoned, and rendered less effective, by exposure to certain elements/compounds present in engine exhaust gasses, particularly by exposure to phosphorus and phosphorus compounds introduced into the exhaust gas by the degradation of phosphorus-containing lubricating oil additives. Further, engines may be provided with aftertreatment devices containing reduction catalysts, which catalysts are sensitive to sulfur and sulfur compounds.

One of the most effective antioxidant and antiwear agents (from both a performance and cost-effectiveness standpoint) used in lubricating oil compositions for internal combustion engines comprises dihydrocarbyl dithiophosphate metal salts. The metal may be an alkali or alkaline earth metal, or aluminum, lead, tin, molybdenum, manganese, nickel or copper. Of these, zinc salts of dihydrocarbyl dithiophosphate (ZDDP) are most commonly used. While such compounds are particularly effective antioxidants and antiwear agents providing performance that allows lubricating oil compositions to meet API CI-4 requirements for use in cooled EGR equipped engines, such compounds do introduce both phosphorus into the engine that can poison the catalysts used in engine aftertreatment devices, as described supra.

Therefore, it would be advantageous to identify low phophorus API-CI-4 heavy duty diesel lubricating oil compositions that can be used in engines provided with cooled EGR systems, which lubricating oil compositions are also suitable for use in engines provided with aftertreatment devices containing oxidation and/or reduction catalysts.

SUMMARY OF THE INVENTION

In accordance with a first aspect of the invention, there is provided a lubricating oil composition having a total base number of at least about 9, comprising a major amount of oil of lubricating viscosity; an amount of one or more dihydrocarbyl dithiophosphate metal salt introducing into the lubricating oil composition no more than 0.06 wt. % of phosphorus; at least 1.2 wt. % of hindered phenol antioxidant; and boron, and/or a boron-containing compound or compounds in an amount providing said lubricating oil composition with at least 200 ppm by weight of boron, all weight percentages being based on the total weight of the lubricating oil composition.

In accordance with a second aspect of the invention, there is provided a lubricating oil composition, as in the first aspect, meeting API CI-4 specifications.

In accordance with a third aspect of the invention, there is provided a lubricating oil composition, as in the first or second aspect, wherein said one or more dihydrocarbyl dithiophosphate metal salt introduces into the lubricating oil composition no more than 0.12 wt. % of sulfur.

In accordance with a fourth aspect of the present invention, there is provided a heavy duty diesel engine equipped with an aftertreatment device containing an oxidation and/or reduction catalyst, which engine is lubricated with a lubricating oil composition of the first, second or third aspect.

In accordance with a fifth aspect of the invention, there is provided a method of operating a heavy duty diesel engine equipped with an aftertreatment device containing an oxidation and/or reduction catalyst, which method comprises lubricating said engine with a lubricating oil composition of the first, second or third aspect.

Other and further objects, advantages and features of the present invention will be understood by reference to the following specification.

DETAILED DESCRIPTION OF THE INVENTION

As noted above, it is an object of the present invention to provide lubricating oil compositions that can be used in heavy, duty diesel engines that are provided with either an EGR system, or a system that relies on aftertreatment devices containing oxidation catalysts, aftertreatment devices containing reduction catalysts, or both. Lubricating oil compositions that can be used in heavy duty diesel engines that are provided with an EGR system, particularly a cooled EGR system, must provide performance sufficient to pass all tests required for American Petroleum Institute (API) CI-4-certification. To prevent catalyst poisoning, and to render lubricating oil compositions suitable for use in heavy duty diesel engines provided with aftertreatment devices containing oxidation catalysts, aftertreatment devices containing nitration catalysts, or both, these lubricating oil compositions must also contain minimized amounts of materials that can poison such catalysts, particularly phosphorus and sulfur.

Criteria for being classified as a lubricating oil composition for API CI-4 is known to those skilled in the art, as is the manner in which heavy duty diesel engines function using EGR, particularly cooled EGR systems. The manner in which aftertreatment devices containing oxidation catalysts and/or aftertreatment devices containing reduction catalysts function, as well as the composition of such catalysts, would also be known by those of ordinary skill in the art. Examples of a heavy duty diesel engines provided with such aftertreatment devices include "ACERT"-type engines provided by Caterpillar Inc. Therefore, further description of the noted lubricating oil classification, engine systems and aftertreatment devices is unnecessary.

The oils of lubricating viscosity useful in the practice of the invention may range in viscosity from light distillate mineral oils to heavy lubricating oils such as gasoline engine oils, mineral lubricating oils and heavy duty diesel oils. Generally, the viscosity of the oil ranges from about 2 $mm^2$/sec (centistokes) to about 40 $mm^2$/sec, especially from about 3 $mm^2$/sec to about 20 $mm^2$/sec, most preferably from about 4 $mm^2$/sec to about 10 $mm^2$/sec, as measured at 100° C.

Natural oils include animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$–$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl)silicate, tetra-(4-methyl-2-ethylhexyl)silicate, tetra-(p-tert-butyl-phenyl)silicate, hexa-(4-methyl-2-ethylhexyl)disiloxane, poly(methyl)siloxanes and poly(methylphenyl)siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

The oil of lubricating viscosity may comprise a Group I, Group II, Group III, Group IV or Group V base stocks or base oil blends of the aforementioned base stocks. Preferably, the oil of lubricating viscosity is a Group II, Group III, Group IV or Group V base stock, or a mixture thereof, or a mixture of a Group I base stock and one or more a Group II, Group III, Group IV or Group V base stock. The base stock, or base stock blend preferably has a saturate content of at least 65%, more preferably at least 75%, such as at least 85%. Most preferably, the base stock, or base stock blend, has a saturate content of greater than 90%. Preferably, the oil or oil blend will have a sulfur content of less than 1%, preferably less than 0.6%, most preferably less than 0.3%, by weight.

Preferably the volatility of the oil or oil blend, as measured by the NOACK test (ASTM D5880), is less than or equal to 30%, preferably less than or equal to 25%, more preferably less than or equal to 20%, most preferably less than or equal 16%. Preferably, the viscosity index (VI) of the oil or oil blend is at least 85, preferably at least 100, most preferably from about 105 to 140. Also preferably, the oil or oil blend will have a sulfur content of no more than 0.8 wt. %, preferably no more than 0.5 wt. %, more preferably no more than 0.3 wt. %.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base stocks contain less than 90 percent saturates and/or greater than 0.03 percent sulfur and have a viscosity index greater than or equal to 80 and less than 120 using the test methods specified in Table 1.

b) Group II base stocks contain greater than or equal to 90 percent saturates and less than or equal to 0.03 percent sulfur and have a viscosity index greater than or equal to 80 and less than 120 using the test methods specified in Table 1.

c) Group III base stocks contain greater than or equal to 90 percent saturates and less than or equal to 0.03 percent sulfur and have a viscosity index greater than or equal to 120 using the test methods specified in Table 1.

d) Group IV base stocks are polyalphaolefins (PAO).

e) Group V base stocks include all other base stocks not included in Group I, II, III, or IV.

TABLE 1

Analytical Methods for Base Stock

| Property | Test Method |
|---|---|
| Saturates | ASTM D 2007 |
| Viscosity Index | ASTM D 2270 |
| Sulfur | ASTM D 4294 |

Dihydrocarbyl dithiophosphate metal salts used as anti-wear and antioxidant agents include those in which the metal is an alkali or alkaline earth metal, or aluminum, lead, tin, molybdenum, manganese, nickel or copper. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

The preferred zinc dihydrocarbyl dithiophosphates are oil soluble salts of dihydrocarbyl dithiophosphoric acids and may be represented by the following formula:

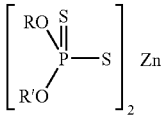

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate (ZDDP) can therefore comprise zinc dialkyl dithiophosphates. ZDDP is the most commonly used antioxidant/antiwear agent in lubricating oil compositions for internal combustion engines, and in conventional heavy duty diesel engines formulated to meet API CI-4 specifications, ZDDP are present in lubricating oil in amounts of from about 1 to about 1.5 wt. %, based upon the total weight of the lubricating oil composition. This amount of ZDDP introduces from about 0.1 to about 0.14 wt. % of phosphorus into the lubricating oil composition. In contrast, the lubricating oil compositions of the present invention contain an amount of ZDDP (or other dihydrocarbyl dithiophosphate metal salt) that introduces zero to less than about 0.06 wt. %, such as e.g., 0.02 to 0.06 wt. %, preferably zero less than 0.05 wt. %, such as 0.02 to 0.05 wt. %; more preferably zero to less than 0.04 wt. %, such as 0.02 to 0.04 wt. % of phosphorus into the lubricating oil composition. The phosphorus content of the lubricating oil compositions is determined in accordance with the procedures of ASTM D5185. Preferably, the ZDDP also introduces zero to less than about 0.12 wt. %, such as 0.04 to 0.12 wt. %, preferably zero less than 0.10 wt. %, such as 0.004 to 0.10 wt. %; more preferably zero to less than 0.08 wt. %, such as 0.04 to 0.08 wt. % of sulfur into the lubricating oil composition.

Lubricating oil compositions of the present invention contain at least 200 ppm of boron, preferably at least 300 ppm of boron, more preferably at least 400 ppm of boron. Amounts over 500 ppm of boron may be provided but under normal circumstances are not required to meet API CI-4 specifications in the low-phosphorus lubricating oil compositions of the present invention. The boron can be introduced into the lubricating oil composition by a borated dispersant, or other boron-containing additive, or a mixture thereof, or by addition of elemental boron or other boron compound.

Dispersants maintain in suspension materials resulting from oxidation during use that are insoluble in oil, thus preventing sludge flocculation and precipitation, or deposition on metal parts. Dispersants useful in the context of the present invention include the range of nitrogen-containing, ashless (metal-free) dispersants known to be effective to reduce formation of deposits upon use in gasoline and diesel engines, when added to lubricating oils. The ashless, dispersants of the present invention comprise an oil soluble polymeric long chain backbone having functional groups capable of associating with particles to be dispersed. Typically, such dispersants have amine, amine-alcohol or amide polar moieties attached to the polymer backbone, often via a bridging group. The ashless dispersant may be, for example, selected from oil soluble salts, esters, amino-esters, amides, imides and oxazolines of long chain hydrocarbon-substituted mono- and polycarboxylic acids or anhydrides thereof; thiocarboxylate derivatives of long chain hydrocarbons; long chain aliphatic hydrocarbons having polyamine moieties attached directly thereto; and Mannich condensation products formed by condensing a long chain substituted phenol with formaldehyde and polyalkylene polyamine.

Generally, each mono- or dicarboxylic acid-producing moiety will react with a nucleophilic group (amine or amide) and the number of functional groups in the polyalkenyl-substituted carboxylic acylating agent will determine the number of nucleophilic groups in the finished dispersant.

The polyalkenyl moiety of the dispersant of the present invention has a number average molecular weight of from about at least about 1500, preferably between 1800 and 3000, such as between 2000 and 2800, more preferably from about 2100 to 2500, and most preferably from about 2150 to about 2400. The molecular weight of a dispersant is generally expressed in terms of the molecular weight of the polyalkenyl moiety as the precise molecular weight range of the dispersant depends on numerous parameters including the type of polymer used to derive the dispersant, the number of functional groups, and the type of nucleophilic group employed. It is preferred that all the dispersant or dispersants used (including all nitrogen-containing dispersant and any nitrogen-free dispersant) be derived from hydrocarbon polymers having an average number average molecular weight ($M_n$) of from about 1500 to about 2500, preferably from about 1800 to 2400, more preferably from about 2000 to about 2300.

The polyalkenyl moiety from which dispersants of the present invention may be derived has a narrow molecular weight distribution (MWD), also referred to as polydispersity, as determined by the ratio of weight average molecular weight ($M_w$) to number average molecular weight ($M_n$). Specifically, polymers from which the dispersants of the present invention are derived have a $M_w/M_n$ of from about 1.5 to about 2.0, preferably from about 1.5 to about 1.9, most preferably from about 1.6 to about 1.8.

Suitable hydrocarbons or polymers employed in the formation of the dispersants of the present invention include homopolymers, interpolymers or lower molecular weight hydrocarbons. One family of such polymers comprise polymers of ethylene and/or at least one $C_3$ to $C_{28}$ alpha-olefin having the formula $H_2C{=}CHR^1$ wherein $R^1$ is straight or branched chain alkyl radical comprising 1 to 26 carbon atoms and wherein the polymer contains carbon-to-carbon unsaturation, preferably a high degree of terminal ethenylidene unsaturation. Preferably, such polymers comprise interpolymers of ethylene and at least one alpha-olefin of the above formula, wherein $R^1$ is alkyl of from 1 to 18 carbon atoms, and more preferably is alkyl of from 1 to 8 carbon atoms, and more preferably still of from 1 to 2 carbon atoms. Therefore, useful alpha-olefin monomers and comonomers include, for example, propylene, butene-1, hexene-1, octene-1, 4-methylpentene-1, decene-1, dodecene-1, tridecene-1, tetradecene-1, pentadecene-1, hexadecene-1, heptadecene-1, octadecene-1, nonadecene-1, and mixtures thereof (e.g., mixtures of propylene and butene-1, and the like). Exemplary of such polymers are propylene homopolymers, butene-1 homopolymers, ethylene-propylene copolymers, ethylene-butene-1 copolymers, propylene-butene copolymers and the like, wherein the polymer contains at least some terminal and/or internal unsaturation. Preferred polymers are unsaturated copolymers of ethylene and propylene and ethylene and butene-1. The interpolymers of this invention may contain a minor amount, e.g. 0.5 to 5 mole % of a $C_4$ to $C_{18}$ non-conjugated diolefin comonomer. However, it is preferred that the polymers of this invention comprise only alpha-olefin homopolymers, interpolymers of alpha-olefin comonomers and interpolymers of ethylene and alpha-olefin comonomers. The molar ethylene content of the polymers employed in this invention is preferably in the range of 0 to 80%, and more preferably 0 to 60%. When propylene and/or butene-1 are employed as comonomer(s) with ethylene, the ethylene content of such copolymers is most preferably between 15 and 50%, although higher or lower ethylene contents may be present.

These polymers may be prepared by polymerizing alpha-olefin monomer, or mixtures of alpha-olefin monomers, or mixtures comprising ethylene and at least one $C_3$ to $C_{28}$ alpha-olefin monomer, in the presence of a catalyst system comprising at least one metallocene (e.g., a cyclopentadienyl-transition metal compound) and an alumoxane compound. Using this process, a polymer in which 95% or more of the polymer chains possess terminal ethenylidene-type unsaturation can be provided. The percentage of polymer chains exhibiting terminal ethenylidene unsaturation may be determined by FTIR spectroscopic analysis, titration, or $C^{13}$ NMR. Interpolymers of this latter type may be characterized by the formula POLY-$C(R^1){=}CH_2$ wherein $R^1$ is $C_1$ to $C_{26}$ alkyl, preferably $C_1$ to $C_{18}$ alkyl, more preferably $C_1$ to $C_8$ alkyl, and most preferably $C_1$ to $C_2$ alkyl, (e.g., methyl or ethyl) and wherein POLY represents the polymer chain. The chain length of the $R^1$ alkyl group will vary depending on the comonomer(s) selected for use in the polymerization. A minor amount of the polymer chains can contain terminal ethenyl, i.e., vinyl, unsaturation, i.e. POLY-$CH{=}CH_2$, and a portion of the polymers can contain internal monounsaturation, e.g. POLY-$CH{=}CH(R^1)$, wherein $R^1$ is as defined above. These terminally unsaturated interpolymers may be prepared by known metallocene chemistry and may also be prepared as described in U.S. Pat. Nos. 5,498,809; 5,663,130; 5,705,577; 5,814,715; 6,022,929 and 6,030,930.

Another useful class of polymers is polymers prepared by cationic polymerization of isobutene, styrene, and the like. Common polymers from this class include polyisobutenes obtained by polymerization of a $C_4$ refinery stream having a butene content of about 35 to about 75% by wt., and an isobutene content of about 30 to about 60% by wt., in the presence of a Lewis acid catalyst, such as aluminum trichloride or boron trifluoride. A preferred source of monomer for making poly-n-butenes is petroleum feedstreams such as Raffinate II. These feedstocks are disclosed in the art such as in U.S. Pat. No. 4,952,739. Polyisobutylene is a most preferred backbone of the present invention because it is readily available by cationic polymerization from butene streams (e.g., using $AlCl_3$ or $BF_3$ catalysts). Such polyisobutylenes generally contain residual unsaturation in amounts of about one ethylenic double bond per polymer chain, positioned along the chain. A preferred embodiment utilizes polyisobutylene prepared from a pure isobutylene stream or a Raffinate I stream to prepare reactive isobutylene polymers with terminal vinylidene olefins. Preferably, these polymers, referred to as highly reactive polyisobutylene (HR-PIB), have a terminal vinylidene content of at least 65%, e.g., 70%, more preferably at least 80%, most preferably, at least 85%. The preparation of such polymers is described, for example, in U.S. Pat. No. 4,152,499. HR-PIB is known and HR-PIB is commercially available under the tradenames Glissopal™ (from BASF) and Ultravis™ (from BP-Amoco).

Polyisobutylene polymers that may be employed are generally based on a hydrocarbon chain of from about 1800 to 3000. Methods for making polyisobutylene are known. Polyisobutylene can be functionalized by halogenation (e.g. chlorination), the thermal "ene" reaction, or by free radical grafting using a catalyst (e.g. peroxide), as described below.

The hydrocarbon or polymer backbone can be functionalized, e.g., with carboxylic acid producing moieties (preferably acid or anhydride moieties) selectively at sites of carbon-to-carbon unsaturation on the polymer or hydrocarbon chains, or randomly along chains using any of the three processes mentioned above or combinations thereof, in any sequence.

Processes for reacting polymeric hydrocarbons with unsaturated carboxylic acids, anhydrides or esters and the preparation of derivatives from such compounds are disclosed in U.S. Pat. Nos. 3,087,936; 3,172,892; 3,215,707; 3,231,587; 3,272,746; 3,275,554; 3,381,022; 3,442,808; 3,565,804; 3,912,764; 4,110,349; 4,234,435; 5,777,025; 5,891,953; as well as EP 0 382 450 B1; CA-1,335,895 and GB-A-1,440,219. The polymer or hydrocarbon may be functionalized, for example, with carboxylic acid producing moieties (preferably acid or anhydride) by reacting the polymer or hydrocarbon under conditions that result in the addition of functional moieties or agents, i.e., acid, anhydride, ester moieties, etc., onto the polymer or hydrocarbon chains primarily at sites of carbon-to-carbon unsaturation (also referred to as ethylenic or olefinic unsaturation) using the halogen assisted functionalization (e.g. chlorination) process or the thermal "ene" reaction.

Selective functionalization can be accomplished by halogenating, e.g., chlorinating or brominating the unsaturated α-olefin polymer to about 1 to 8 wt. %, preferably 3 to 7 wt. % chlorine, or bromine, based on the weight of polymer or hydrocarbon, by passing the chlorine or bromine through the polymer at a temperature of 60 to 250° C., preferably 110 to 160° C., e.g., 120 to 140° C., for about 0.5 to 10, preferably 1 to 7 hours. The halogenated polymer or hydrocarbon (hereinafter backbone) is then reacted with sufficient monounsaturated reactant capable of adding the required number of functional moieties to the backbone, e.g., monounsaturated carboxylic reactant, at 100 to 250° C., usually about 180° C. to 235° C., for about 0.5 to 10, e.g., 3 to 8 hours, such that the product obtained will contain the desired number of moles of the monounsaturated carboxylic reactant per mole of the halogenated backbones. Alternatively, the backbone and the monounsaturated carboxylic reactant are mixed and heated while adding chlorine to the hot material.

While chlorination normally helps increase the reactivity of starting olefin polymers with monounsaturated functionalizing reactant, it is not necessary with some of the polymers or hydrocarbons contemplated for use in the present invention, particularly those preferred polymers or hydrocarbons which possess a high terminal bond content and reactivity. Preferably, therefore, the backbone and the monounsaturated functionality reactant, e.g., carboxylic reactant, are contacted at elevated temperature to cause an initial thermal "ene" reaction to take place. Ene reactions are known.

The hydrocarbon or polymer backbone can be functionalized by random attachment of functional moieties along the polymer chains by a variety of methods. For example, the polymer, in solution or in solid form, may be grafted with the monounsaturated carboxylic reactant, as described above, in the presence of a free-radical initiator. When performed in solution, the grafting takes place at an elevated temperature in the range of about 100 to 260° C., preferably 120 to 240° C. Preferably, free-radical initiated grafting would be accomplished in a mineral lubricating oil solution containing, e.g., 1 to 50 wt. %, preferably 5 to 30 wt. % polymer based on the initial total oil solution.

The free-radical initiators that may be used are peroxides, hydroperoxides, and azo compounds, preferably those that have a boiling point greater than about 100° C. and decompose thermally within the grafting temperature range to provide free-radicals. Representative of these free-radical initiators are azobutyronitrile, 2,5-dimethylhex-3-ene-2,5-bis-tertiary-butyl peroxide and dicumene peroxide. The initiator, when used, typically is used in an amount of between 0.005% and 1% by weight based on the weight of the reaction mixture solution. Typically, the aforesaid monounsaturated carboxylic reactant material and free-radical initiator are used in a weight ratio range of from about 1.0:1 to 30:1, preferably 3:1 to 6:1. The grafting is preferably carried out in an inert atmosphere, such as under nitrogen blanketing. The resulting grafted polymer is characterized by having carboxylic acid (or ester or anhydride) moieties randomly attached along the polymer chains: it being understood, of course, that some of the polymer chains remain ungrafted. The free radical grafting described above can be used for the other polymers and hydrocarbons of the present invention.

The preferred monounsaturated reactants that are used to functionalize the backbone comprise mono- and dicarboxylic acid material, i.e., acid, anhydride, or acid ester material, including (i) monounsaturated $C_4$ to $C_{10}$ dicarboxylic acid wherein (a) the carboxyl groups are vicinyl, (i.e., located on adjacent carbon atoms) and (b) at least one, preferably both, of said adjacent carbon atoms are part of said mono unsaturation; (ii) derivatives of (i) such as anhydrides or $C_1$ to $C_5$ alcohol derived mono- or diesters of (i); (iii) monounsaturated $C_3$ to $C_{10}$ monocarboxylic acid wherein the carbon-carbon double bond is conjugated with the carboxy group, i.e., of the structure —C═C—CO—; and (iv) derivatives of (iii) such as $C_1$ to $C_5$ alcohol derived mono- or diesters of (iii). Mixtures of monounsaturated carboxylic materials (i)–(iv) also may be used. Upon reaction with the backbone, the monounsaturation of the monounsaturated carboxylic reactant becomes saturated. Thus, for example, maleic anhydride becomes backbone-substituted succinic anhydride, and acrylic acid becomes backbone-substituted propionic acid. Exemplary of such monounsaturated carboxylic reactants are fumaric acid, itaconic acid, maleic acid, maleic anhydride, chloromaleic acid, chloromaleic anhydride, acrylic acid, methacrylic acid, crotonic acid, cinnamic acid, and lower alkyl (e.g., $C_1$ to $C_4$ alkyl) acid esters of the foregoing, e.g., methyl maleate, ethyl fumarate, and methyl fumarate.

To provide the required functionality, the monounsaturated carboxylic reactant, preferably maleic anhydride, typically will be used in an amount ranging from about equimolar amount to about 100 wt. % excess, preferably 5 to 50 wt. % excess, based on the moles of polymer or hydrocarbon. Unreacted excess monounsaturated carboxylic reactant can be removed from the final dispersant product by, for example, stripping, usually under vacuum, if required.

The functionalized oil-soluble polymeric hydrocarbon backbone is then derivatized with a nitrogen-containing nucleophilic reactant, such as an amine, amino-alcohol, amide, or mixture thereof, to form a corresponding derivative. Amine compounds are preferred. Useful amine compounds for derivatizing functionalized polymers comprise at least one amine and can comprise one or more additional amine or other reactive or polar groups. These amines may be hydrocarbyl amines or may be predominantly hydrocarbyl amines in which the hydrocarbyl group includes other groups, e.g., hydroxy groups, alkoxy groups, amide groups, nitriles, imidazoline groups, and the like. Particularly useful amine compounds include mono- and polyamines, e.g., polyalkene and polyoxyalkylene polyamines of about 2 to 60, such as 2 to 40 (e.g., 3 to 20) total carbon atoms having about 1 to 12, such as 3 to 12, preferably 3 to 9, most preferably form about 6 to about 7 nitrogen atoms per molecule. Mixtures of amine compounds may advantageously be used, such as those prepared by reaction of alkylene dihalide with ammonia. Preferred amines are aliphatic saturated amines, including, for example, 1,2-diaminoethane; 1,3-diaminopropane; 1,4-diaminobutane; 1,6-diaminohexane; polyethylene amines such as diethylene triamine; triethylene tetramine; tetraethylene pentamine; and polypropyleneamines such as 1,2-propylene diamine; and di-(1,2-propylene)triamine. Such polyamine mixtures, known as PAM, are commercially available. Particularly preferred polyamine mixtures are mixtures derived by distilling the light ends from PAM products. The resulting mixtures, known as "heavy" PAM, or HPAM, are also commercially available. The properties and attributes of both PAM and/or HPAM are described, for example, in U.S. Pat. Nos. 4,938,881; 4,927,551; 5,230,714; 5,241,003; 5,565,128; 5,756,431; 5,792,730; and 5,854,186.

Other useful amine compounds include: alicyclic diamines such as 1,4-di(aminomethyl)cyclohexane and heterocyclic nitrogen compounds such as imidazolines. Another useful class of amines is the polyamido and related amido-amines as disclosed in U.S. Pat. Nos. 4,857,217; 4,956,107; 4,963,275; and 5,229,022. Also usable is tris (hydroxymethyl)amino methane (TAM) as described in U.S. Pat. Nos. 4,102,798; 4,113,639; 4,116,876; and UK 989,409. Dendrimers, star-like amines, and comb-structured amines may also be used. Similarly, one may use condensed amines, as described in U.S. Pat. No. 5,053,152. The functionalized polymer is reacted with the amine compound using conventional techniques as described, for example, in U.S. Pat. Nos. 4,234,435 and 5,229,022, as well as in EP-A-208,560.

A preferred dispersant composition is one comprising at least one polyalkenyl succinimide, which is the reaction product of a polyalkenyl substituted succinic anhydride (e.g., PIBSA) and a polyamine (PAM) that has a coupling ratio of from about 0.65 to about 1.25, preferably from about 0.8 to about 1.1, most preferably from about 0.9 to about 1. In the context of this disclosure, "coupling ratio" may be defined as a ratio of the number of succinyl groups in the PIBSA to the number of primary amine groups in the polyamine reactant.

Another class of high molecular weight ashless dispersants comprises Mannich base condensation products. Generally, these products are prepared by condensing about one mole of a long chain alkyl-substituted mono- or polyhydroxy benzene with about 1 to 2.5 moles of carbonyl compound(s) (e.g., formaldehyde and paraformaldehyde) and about 0.5 to 2 moles of polyalkylene polyamine, as disclosed, for example, in U.S. Pat. No. 3,442,808. Such Mannich base condensation products may include a polymer product of a metallocene catalyzed polymerization as a substituent on the benzene group, or may be reacted with a compound containing such a polymer substituted on a succinic anhydride in a manner similar to that described in U.S. Pat. No. 3,442,808. Examples of functionalized and/or derivatized olefin polymers synthesized using metallocene catalyst systems are described in the publications identified supra.

The dispersant(s) of the present invention are preferably non-polymeric (e.g., are mono- or bis-succinimides). It is further preferred that the dispersant or dispersants contribute, in total, from about 0.10 to about 0.20 wt. %, preferably from about 0.115 to about 0.18 wt. %, most preferably from about 0.12 to about 0.16 wt. % of nitrogen to the lubricating oil composition.

Dispersants can be borated by conventional means, as generally taught in U.S. Pat. Nos. 3,087,936, 3,254,025 and 5,430,105. Boration of the dispersant is readily accomplished by treating an acyl nitrogen-containing dispersant with a boron compound such as boron oxide, boron halide boron acids, and esters of boron acids, in an amount sufficient to provide from about 0.1 to about 20 atomic proportions of boron for each mole of acylated nitrogen composition.

The boron, which appears in the product as dehydrated boric acid polymers (primarily $(HBO_2)_3$), is believed to attach to the dispersant imides and diimides as amine salts, e.g., the metaborate salt of the diimide. Boration can be carried out by adding a sufficient quantity of a boron compound, preferably boric acid, usually as a slurry, to the acyl nitrogen compound and heating with stirring at from about 135° C. to about 190° C., e.g., 140° C. to 170° C., for from about 1 to about 5 hours, followed by nitrogen stripping. Alternatively, the boron treatment can be conducted by adding boric acid to a hot reaction mixture of the dicarboxylic acid material and amine, while removing water. Other post reaction processes known in the art can also be applied.

Non-dispersant boron sources are prepared by reacting a boron compound with an oil-soluble or oil-dispersible additive or compound. Boron compounds include boron oxide, boron oxide hydrate, boron trioxide, boron trifluoride, boron tribromide, boron trichloride, boron acid such as boronic acid, boric acid, tetraboric acid and metaboric acid, boron hydrides, boron amides and various esters of boron acids. Suitable "non-dispersant boron sources" may comprise any oil-soluble, boron-containing compound, but preferably comprise one or more boron-containing additives known to impart enhanced properties to lubricating oil compositions. Such boron-containing additives include, for example, borated dispersant VI improver; alkali metal, mixed alkali metal or alkaline earth metal borate; borated overbased metal detergent; borated epoxide; borate ester; and borate amide.

Alkali metal and alkaline earth metal borates are generally hydrated particulate metal borates, which are known in the art. Alkali metal borates include mixed alkali and alkaline earth metal borates. These metal borates are available commercially. Representative patents describing suitable alkali metal and alkaline earth metal borates and their methods of manufacture include U.S. Pat. Nos. 3,997,454; 3,819,521; 3,853,772; 3,907,601; 3,997,454; and 4,089,790.

The borated amines maybe prepared by reacting one or more of the above boron compounds with one or more of fatty amines, e.g., an amine having from four to eighteen carbon atoms. They may be prepared by reacting the amine with the boron compound at a temperature of from 50 to 300, preferably from 100 to 250° C. and at a ratio from 3:1 to 1:3 equivalents of amine to equivalents of boron compound.

Borated fatty epoxides are generally the reaction product of one or more of the above boron compounds with at least one epoxide. The epoxide is generally an aliphatic epoxide having from 8 to 30, preferably from 10 to 24, more preferably from 12 to 20, carbon atoms. Examples of useful aliphatic epoxides include heptyl epoxide and octyl epoxide. Mixtures of epoxides may also be used, for instance commercial mixtures of epoxides having from 14 to 16 carbon atoms and from 14 to 18 carbon atoms. The borated fatty epoxides are generally known and are described in U.S. Pat. No. 4,584,115.

Borate esters may be prepared by reacting one or more of the above boron compounds with one or more alcohol of suitable oleophilicity. Typically, the alcohol contains from 6 to 30, or from 8 to 24, carbon atoms. Methods of making such borate esters are known in the art.

The borate esters can be borated phospholipids. Such compounds, and processes for making such compounds, are described in EP-A-0 684 298. Borated overbased metal detergents are known in the art where the borate substitutes the carbonate in the core either in part or in full.

Oxidation inhibitors or antioxidants reduce the tendency of mineral oils to deteriorate in service. Oxidative deterioration can be evidenced by sludge in the lubricant, varnish-like deposits on the metal surfaces, and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, oil soluble phenates and sulfurized phenates, phosphosulfurized or sulfurized hydrocarbons or esters, phosphorous esters, metal thiocarbamates, oil soluble copper compounds as described in U.S. Pat. No. 4,867,890, and molybdenum-containing compounds.

Lubricating oil compositions in accordance with the present invention contain at least 1.2 wt. %, such as 1.2 to about 5 wt. %, preferably from about 1.3 wt. % to about 5.0 wt. %, most preferably from about 1.4 wt. % to about 2.0 wt. % of hindered phenol antioxidant, based on the total weight of the lubricating oil composition. Generally, hindered phenols are oil soluble phenols substituted at one or both ortho positions. Suitable compounds include monohydric and mononuclear phenols such as 2,6-di-tertiary alkylphenols (e.g. 2,6 di-t-butylphenol, 2,4,6 tri-t-butyl phenol, 2-t-butyl phenol, 4-alkyl, 2,6, t-butyl phenol, 2,6 di-isopropylphenol, and 2,6 dimethyl, 4 t-butyl phenol). Other suitable hindered phenols include polyhydric and polynuclear phenols such as alkylene bridged hindered phenols (4,4 methylenebis(6 tert butyl-o-cresol), 4,4'-methylenebis(2-tert-amyl-o-cresol), and 2,2'-methylenebis(2.6-di-t-butylphenol)). The hindered phenol may be borated, in which case the hindered phenol contributes to the boron content of the lubricating oil composition, or sulfurized. Preferred hindered phenols have good oil solubility and relatively low volatility.

Additional additives may be incorporated into the compositions of the invention to enable particular performance requirements to be met. Examples of additives which may be included in the lubricating oil compositions of the present invention are supplemental, phosphorus-free antioxidants, detergents, metal rust inhibitors, viscosity index improvers, corrosion inhibitors, anti-foaming agents, and pour point depressants. Some are discussed in further detail below.

Phosphorus-free supplemental oxidation inhibitors, other than the previously described hindered phenol antioxidants, suitable for use in the present invention include alkaline earth metal salts of alkylphenolthioesters having preferably $C_5$ to $C_{12}$ alkyl side chains, calcium nonylphenol sulfide, ashless oil soluble phenates and sulfurized phenates and phosphosulfurized or sulfurized hydrocarbons.

Aromatic amines having at least two aromatic groups attached directly to the nitrogen constitute another class of compounds that is frequently used for antioxidancy. While these materials may be used in small amounts, preferred embodiments of the present invention are free of these compounds. Typical oil soluble aromatic amines having at least two aromatic groups attached directly to one amine nitrogen contain from 6 to 16 carbon atoms. The amines may contain more than two aromatic groups. Compounds having a total of at least three aromatic groups in which two aromatic groups are linked by a covalent bond or by an atom or group (e.g., an oxygen or sulfur atom, or a —CO—, —$SO_2$— or alkylene group) and two are directly attached to one amine nitrogen also considered aromatic amines having at least two aromatic groups attached directly to the nitrogen. The aromatic rings are typically substituted by one or more substituents selected from alkyl, cycloalkyl, alkoxy, aryloxy, acyl, acylamino, hydroxy, and nitro groups. When needed, the use of at least one of a hindered phenol and aromatic amine antioxidant, or in combination thereof, is preferred.

Metal-containing or ash-forming detergents function both as detergents to reduce or remove deposits and as acid neutralizers or rust inhibitors, thereby reducing wear and corrosion and extending engine life. Detergents generally comprise a polar head with long hydrophobic tail, with the polar head comprising a metal salt of an acid organic compound. The salts may contain a substantially stoichiometric amount of the metal in which they are usually described as normal or neutral salts, and would typically have a total base number (TBN), as may be measured by ASTM D-2896 of from 0 to 80. It is possible to include large amounts of a metal base by reacting an excess of a metal compound such as an oxide or hydroxide with an acid gas such a such as carbon dioxide. The resulting overbased detergent comprises neutralized detergent as the outer layer of a metal base (e.g., carbonate) micelle. Such overbased detergents may have a TBN of 150 or greater, and typically from 250 to 450 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., barium, sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from 20 to 450, neutral and overbased calcium phenates and sulfurized phenates having TBN of from 50 to 450 and neutral and overbased magnesium or calcium salicylates having a TBN of from 20 to 450. Combinations of detergents, whether overbased or neutral or both, may be used.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 wt. % (preferably at least 125 wt. %) of that stoichiometrically required.

Metal salts of phenols and sulfurized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

Carboxylate detergents, e.g., salicylates, can be prepared by reacting an aromatic carboxylic acid with an appropriate metal compound such as an oxide or hydroxide and neutral or overbased products may be obtained by methods well known in the art. The aromatic moiety of the aromatic carboxylic acid can contain heteroatoms, such as nitrogen and oxygen. Preferably, the moiety contains only carbon atoms; more preferably the moiety contains six or more carbon atoms; for example benzene is a preferred moiety. The aromatic carboxylic acid may contain one or more aromatic moieties, such as one or more benzene rings, either fused or connected via alkylene bridges. The carboxylic moiety may be attached directly or indirectly to the aromatic moiety. Preferably the carboxylic acid group is attached directly to a carbon atom on the aromatic moiety, such as a carbon atom on the benzene ring. More preferably, the aromatic moiety also contains a second functional group, such as a hydroxy group or a sulfonate group, which can be attached directly or indirectly to a carbon atom on the aromatic moiety.

Preferred examples of aromatic carboxylic acids are salicylic acids and sulfurized derivatives thereof, such as hydrocarbyl substituted salicylic acid and derivatives thereof. Processes for sulfurizing, for example a hydrocarbyl—substituted salicylic acid, are known to those skilled in the art. Salicylic acids are typically prepared by carboxylation, for example, by the Kolbe—Schmitt process, of phenoxides, and in that case, will generally be obtained, normally in a diluent, in admixture with uncarboxylated phenol.

Preferred substituents in oil—soluble salicylic acids are alkyl substituents. In alkyl—substituted salicylic acids, the alkyl groups advantageously contain 5 to 100, preferably 9 to 30, especially 14 to 20, carbon atoms. Where there is more than one alkyl group, the average number of carbon atoms in all of the alkyl groups is preferably at least 9 to ensure adequate oil solubility.

Detergents generally useful in the formulation of lubricating oil compositions also include "hybrid" detergents formed with mixed surfactant systems, e.g., phenate/salicylates, sulfonate/phenates, sulfonate/salicylates, sulfonates/phenates/salicylates, as described, for example, in pending U.S. patent application Ser. Nos. 09/180,435 and 09/180,436 and U.S. Pat. Nos. 6,153,565 and 6,281,179.

Lubricating oil compositions formulated for use in heavy duty diesel engines require a relatively great acid neutralizing capability, and therefore, lubricating oil compositions in accordance with the present invention will contain one or more detergent in amounts providing the lubricating oil composition with a TBN of greater than about 8, such as 8 to 14, preferably greater than 9, such as about 9 to about 14, more preferably greater than 10, such as about 10 to about 14.

It is not unusual to add a detergent or other additive, to a lubricating oil, or additive concentrate, in a diluent, such that only a portion of the added weight represents an active ingredient (A.I.). For example, detergent may be added together with an equal weight of diluent in which case the "additive" is 50% A.I. detergent. As used herein, the term weight percent (wt. %), when applied to a detergent or other additive refers to the weight of active ingredient. To provide the lubricating oil composition with required TBN detergents may comprise from about 0.5 to about 5 wt. %, preferably from about 0.8 to about 3.8 wt. %, most preferably from about 1.2 to about 3 wt. % of a lubricating oil composition formulated for use in a heavy duty diesel engine.

The viscosity modifier (VM) functions to impart high and low temperature operability to a lubricating oil. The VM used may have that sole function, or may be multifunctional. Representative examples of suitable viscosity modifiers are polyisobutylene, copolymers of ethylene and propylene, polymethacrylates, methacrylate copolymers, copolymers of an unsaturated dicarboxylic acid and a vinyl compound, interpolymers of styrene and acrylic esters, and partially hydrogenated copolymers of styrene/isoprene, styrenelbutadiene, and isoprene/butadiene, as well as the partially hydrogenated homopolymers of butadiene and isoprene. Multifunctional viscosity modifiers that further function as dispersants are also known.

A viscosity index improver dispersant functions both as a viscosity index improver and as a dispersant. Examples of viscosity index improver dispersants include reaction products of amines, for example polyamines, with a hydrocarbyl-substituted mono-or dicarboxylic acid in which the hydrocarbyl substituent comprises a chain of sufficient length to impart viscosity index improving properties to the compounds. In general, the viscosity index improver dispersant may be, for example, a polymer of a $C_4$ to $C_{24}$ unsaturated ester of vinyl alcohol or a $C_3$ to $C_{10}$ unsaturated monocarboxylic acid or a $C_4$ to $C_{10}$ di-carboxylic acid with an unsaturated nitrogen-containing monomer having 4 to 20 carbon atoms; a polymer of a $C_2$ to $C_{20}$ olefin with an unsaturated $C_3$ to $C_{10}$ mono- or di-carboxylic acid neutralised with an amine, hydroxyamine or an alcohol; or a polymer of ethylene with a $C_3$ to $C_{20}$ olefin further reacted either by grafting a $C_4$ to $C_{20}$ unsaturated nitrogen-containing monomer thereon or by grafting an unsaturated acid onto the polymer backbone and then reacting carboxylic acid groups of the grafted acid with an amine, hydroxy amine or alcohol.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_8$ dialkyl fumarate/vinyl acetate copolymers, polyalkylmethacrylates and the like.

Friction modifiers and fuel economy agents that are compatible with the other ingredients of the final oil may also be included. Examples of such materials include glyceryl monoesters of higher fatty acids, for example, glyceryl mono-oleate; esters of long chain polycarboxylic acids with diols, for example, the butane diol ester of a dimerized unsaturated fatty acid; oxazoline compounds; and alkoxylated alkyl-substituted mono-amines, diamines and alkyl ether amines, for example, ethoxylated tallow amine and ethoxylated tallow ether amine.

Other known friction modifiers comprise oil-soluble organo-molybdenum compounds. Such organo-molybdenum friction modifiers also provide antioxidant and antiwear credits to a lubricating oil composition. As an example of such oil soluble organo-molybdenum compounds, there may be mentioned the dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds.

Among the molybdenum compounds useful in the compositions of this invention are organo-molybdenum compounds of the formula $Mo(ROCS_2)_4$ and $Mo(RSCS_2)_4$ wherein R is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

Another group of organo-molybdenum compounds useful in the lubricating compositions of this invention are trinuclear molybdenum compounds, especially those of the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The ligands are independently selected from the group of

1 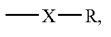

2 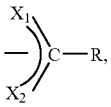

3 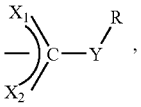

4 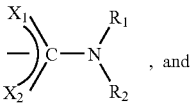

5 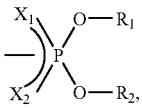

and mixtures thereof, wherein X, $X_1$, $X_2$, and Y are independently selected from the group of oxygen and sulfur, and wherein $R_1$, $R_2$, and R are independently selected from hydrogen and organo groups that may be the same or different. Preferably, the organo groups are hydrocarbyl groups such as alkyl (e.g., in which the carbon atom attached to the remainder of the ligand is primary or secondary), aryl, substituted aryl and ether groups. More preferably, each ligand has the same hydrocarbyl group.

The term "hydrocarbyl" denotes a substituent having carbon atoms directly attached to the remainder of the ligand and is predominantly hydrocarbyl in character within the context of this invention. Such substituents include the following:

1. Hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei and the like, as well as cyclic substituents wherein the ring is completed through another portion of the ligand (that is, any two indicated substituents may together form an alicyclic group).
2. Substituted hydrocarbon substituents, that is, those containing non-hydrocarbon groups which, in the context of this invention, do not alter the predominantly hydrocarbyl character of the substituent. Those skilled in the art will be aware of suitable groups (e.g., halo, especially chloro and fluoro, amino, alkoxyl, mercapto, alkylmercapto, nitro, nitroso, sulfoxy, etc.).
3. Hetero substituents, that is, substituents which, while predominantly hydrocarbon in character within the context of this invention, contain atoms other than carbon present in a chain or ring otherwise composed of carbon atoms.

Importantly, the organo groups of the ligands have a sufficient number of carbon atoms to render the compound soluble or dispersible in the oil. For example, the number of carbon atoms in each group will generally range between about 1 to about 100, preferably from about 1 to about 30, and more preferably between about 4 to about 20. Preferred ligands include dialkyldithiophosphate, alkylxanthate, and dialkyldithiocarbamate, and of these dialkyldithiocarbamate is more preferred. Organic ligands containing two or more of the above functionalities are also capable of serving as ligands and binding to one or more of the cores. Those skilled in the art will realize that formation of the compounds of the present invention requires selection of ligands having the appropriate charge to balance the core's charge.

Compounds having the formula $Mo_3S_kL_nQ_z$ have cationic cores surrounded by anionic ligands and are represented by structures such as 6 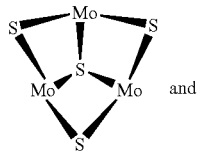

and

7 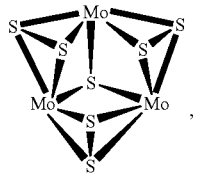

and have net charges of +4. Consequently, in order to solubilize these cores the total charge among all the ligands must be −4. Four monoanionic ligands are preferred. Without wishing to be bound by any theory, it is believed that two or more trinuclear cores may be bound or interconnected by means of one or more ligands and the ligands may be multidentate. Such structures fall within the scope of this invention. This includes the case of a multidentate ligand having multiple connections to a single core. It is believed that oxygen and/or selenium may be substituted for sulfur in the core(s).

Oil-soluble or dispersible trinuclear molybdenum compounds can be prepared by reacting in the appropriate liquid(s)/solvent(s) a molybdenum source such as $(NH_4)_2Mo_3S_{13}.n(H_2O)$, where n varies between 0 and 2 and includes non-stoichiometric values, with a suitable ligand source such as a tetralkylthiuram disulfide. Other oil-soluble or dispersible trinuclear molybdenum compounds can be formed during a reaction in the appropriate solvent(s) of a molybdenum source such as of $(NH_4)_2Mo_3S_{13}.n(H_2O)$, a ligand source such as tetralkylthiuram disulfide, dialkyldithiocarbamate, or dialkyldithiophosphate, and a sulfur abstracting agent such cyanide ions, sulfite ions, or substituted phosphines. Alternatively, a trinuclear molybdenum-sulfur halide salt such as $[M']_2[MO_3S_7A_6]$, where M' is a counter ion, and A is a halogen such as Cl, Br, or I, may be reacted with a ligand source such as a dialkyldithiocarbamate or dialkyldithiophosphate in the appropriate liquid(s)/solvent(s) to form an oil-soluble or dispersible trinuclear molybdenum compound. The appropriate liquid/solvent may be, for example, aqueous or organic.

A compound's oil solubility or dispersibility may be influenced by the number of carbon atoms in the ligand's organo groups. In the compounds of the present invention, at least 21 total carbon atoms should be present among all the ligand's organo groups. Preferably, the ligand source chosen has a sufficient number of carbon atoms in its organo groups to render the compound soluble or dispersible in the lubricating composition.

The terms "oil-soluble" or "dispersible" used herein do not necessarily indicate that the compounds or additives are soluble, dissolvable, miscible, or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

The molybdenum compound is preferably an organo-molybdenum compound. Moreover, the molybdenum compound is preferably selected from the group consisting of a molybdenum dithiocarbamate (MoDTC), molybdenum dithiophosphate, molybdenum dithiophosphinate, molybdenum xanthate, molybdenum thioxanthate, molybdenum sulfide and mixtures thereof. Most preferably, the molybdenum compound is present as molybdenum dithiocarbamate. The molybdenum compound may also be a trinuclear molybdenum compound.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK Patent Specification No. 1,560,830. Benzotriazoles derivatives also fall within this class of additives. When these compounds are included in the lubricating composition, they are preferably present in an amount not exceeding 0.2 wt. % active ingredient.

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Foam control can be provided by many compounds including an antifoamant of the polysiloxane type, for example, silicone oil or polydimethyl siloxane.

In the present invention it may be necessary to include an additive which maintains the stability of the viscosity of the blend. Thus, although polar group-containing additives achieve a suitably low viscosity in the pre-blending stage it has been observed that some compositions increase in viscosity when stored for prolonged periods. Additives which are effective in controlling this viscosity increase include the long chain hydrocarbons functionalized by reaction with mono- or dicarboxylic acids or anhydrides which are used in the preparation of the ashless dispersants as hereinbefore disclosed.

The individual additives may be incorporated into a base stock in any convenient way. Thus, each of the components can be added directly to the base stock or base oil blend by dispersing or dissolving it in the base stock or base oil blend at the desired level of concentration. Such blending may occur at ambient temperature or at an elevated temperature.

Preferably, all the additives except for the viscosity modifier and the pour point depressant are blended into a concentrate or additive package described herein as the additive package, that is subsequently blended into base stock to make the finished lubricant. The concentrate will typically be formulated to contain the additive(s) in proper amounts to provide the desired concentration in the final formulation when the concentrate is combined with a predetermined amount of a base lubricant.

The concentrate is preferably made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

The final crankcase lubricating oil formulation may employ from 2 to 20 mass %, preferably 4 to 18 mass %, and most preferably about 5 to 17 mass % of the concentrate or additive package with the remainder being base stock. Preferably, lubricating oil compositions of the present invention will have an overall sulfur content zero to less than about 1 wt. %, such as 0.1 to 0.8 wt. %, preferably zero to less than 0.6 wt. %, such as 0.1 to 0.6 wt. %; more preferably zero to less than 0.4 wt. %, such as 0.1 to 0.4 wt. % of sulfur. Also preferably, the Noack volatility of the fully formulated lubricating oil composition (oil of lubricating viscosity plus all additives) will be no greater than 17, such as no greater than 15, preferably no greater than 13.

This invention will be further understood by reference to the following examples, wherein all percentages are by weight of active ingredient, unless otherwise noted, and which include preferred embodiments of the invention.

EXAMPLES

15 W 40 grade lubricating oil compositions were formed using identical base oil, detergents, and antifoamants and antioxidants, dispersants and ZDDP, as shown in the Table 2. The amounts of dispersant were adjusted to provide each sample with comparable dispersancy. Example C1 represents a conventional API CI-4 lubricating oil containing relatively high levels of phosphorus. Example C2 is identical to C2, but contains ZDDP in an amount introducing only 0.60 wt. % of phosphorus into the lubricating oil composition. Example I1 represents a low phosphorus (0.06 wt. %) lubricating oil composition of the invention.

TABLE 2

| | Example C1 | Example C2 | Example I1 |
|---|---|---|---|
| Non-borated Dispersant | 9.200 wt. % | 9.200 wt. % | 8.364 wt. % |
| Borated Dispersant | — | — | 2.300 wt. % |
| Diphenylamine Antioxidant | 0.389 wt. % | 0.389 wt. % | — |
| Hindered Phenol Antioxidant | 0.440 wt. % | 0.440 wt. % | 1.400 wt. % |
| ZDDP | 1.650 wt. % | 0.750 wt. % | 0.750 wt. % |
| Phosphorus Content | 0.132 wt. % | 0.060 wt. % | 0.060 wt. % |
| Boron Content | — | — | 300 ppm |
| Boron Content | — | — | 0.030 wt. % |
| Sulfated Ash Content | 1.31 | 1.16 | 1.07 |
| Lubricating Oil TBN | 11.1 | 11.0 | 10.1 |

Each of the above lubricating oil compositions was subjected to the testing for performance characteristics required for API CI-4 certification. The lubricating oil composition C1 provided all performance criteria necessary for CI-4 certification.

However, the level of phosphorus in C1 would render said lubricating oil composition harmful to oxidation and reduction catalysts. Lubricating oil composition C2, which had a reduced ZDDP content, and thus, a reduced level of phosphorus, was unable to pass the anticorrosion test (Mack T10) and crosshead wear test (Cummins M11EGR) required by API CI-4. In contrast, the lubricating oil composition of Example I1, which contained the same amount of ZDDP as C2, but replaced the diphenylamine antioxidant with additional hindered phenol antioxidant such that the composition contained greater than 1.2 wt. % of hindered phenolic antioxidant, and added 300 ppm of boron, passed all tests required by API CI-4, at a phosphorus level rendering said composition suitable for use in heavy duty diesel engines provided with aftertreatment devices containing oxidation and/or reduction catalysts.

The lubricating oil compositions described above were further subjected to a Cummins Bench Corrosion Test or HTCBCT (ASTM D5968). The results are set forth in Table 3.

TABLE 3

| | Example C1 | Example C2 | Example I1 | Passing |
|---|---|---|---|---|
| Copper | 5 | 6 | 8 | <20 |
| Lead | 39 | 165 | 48 | <120 |
| Tin | 0 | −2 | 3 | <50 |

Again, Example C1, which contained the standard amount of ZDDP was able to pass the test. Example C2, which had a reduced amount of ZDDP and a combination of diphenylamine and hindered phenol antioxidants, could not provide the required level of lead corrosion protection. In contrast, the lubricating oil composition of Example I1, which contained the same amount of ZDDP as C2, but replaced the diphenylamine antioxidant with additional hindered phenol antioxidant such that the composition contained greater than 1.2 wt. % of hindered phenolic antioxidant, and added 300 ppm of boron, was able to pass the HTCBT at a phosphorus level rendering said composition suitable for use in heavy duty diesel engines provided with aftertreatment devices containing oxidation and/or reduction catalysts.

The disclosures of all patents, articles and other materials described herein are hereby incorporated, in their entirety, into this specification by reference. Compositions described as "comprising" a plurality of defined components are to be construed as including compositions formed by admixing the defined plurality of defined components The principles, preferred embodiments and modes of operation of the present invention have been described in the foregoing specification. What applicants submit is their invention, however, is not to be construed as limited to the particular embodiments disclosed, since the disclosed embodiments are regarded as illustrative rather than limiting. Changes may be made by those skilled in the art without departing from the spirit of the invention.

What is claimed is:

1. A method of operating a heavy duty diesel engine equipped with an aftertreatment device containing an oxidation and/or reduction catalyst, which method comprises lubricating said engine with a lubricating oil composition having a TBN of at least about 8, said composition comprising:

(a) a major amount of oil of lubricating viscosity;

(b) an amount of one or more dihydrocarbyl dithiophosphate metal salt introducing into said lubricating oil composition no more than 0.06 wt. % of phosphorus;

(c) at least 1.2 wt. % of hindered phenol antioxidant;

(d) boron, and/or a boron-containing compound or compounds in an amount providing said lubricating oil composition with at least 200 ppm by weight of boron; and (e) a minor amount of detergent.

2. The method of claim 1, wherein said lubricating oil composition is an API CI-4 lubricating oil.

3. The method of claim 1, wherein said hindered phenol antioxidant is present in an amount of at least 1.4 wt. %.

4. The method of claim 1, wherein said lubricating oil composition has at least one of:

(a) a phosphorus content of no more than 0.05 wt. %; and (b) a sulfur content of less than about 1.0 wt. %.

5. The method of claim 4, wherein said lubricating oil composition has at least one of:

(a) a phosphorus content of from about 0.02 to about 0.05 wt. %; and (b) a sulfur content of less than about 0.06 wt. %.

6. A heavy duty diesel engine equipped with an aftertreatment device containing an oxidation and/or reduction catalyst, which engine is lubricated with a lubricating oil composition having a TBN of at least about 8, said composition comprising:

(a) a major amount of oil of lubricating viscosity;

(b) an amount of one or more dihydrocarbyl dithiophosphate metal salt introducing into said lubricating oil composition no more than 0.06 wt. % of phosphorus;

(c) at least 1.2 wt. % of hindered phenol antioxidant;

(d) boron, and/or a boron-containing compound or compounds in an amount providing said lubricating oil composition with at least 200 ppm by weight of boron; and (e) a minor amount of a detergent.

7. The engine of claim 6, wherein said lubricating oil composition is an API CI-4 lubricating oil.

8. The engine of claim 6, wherein said hindered phenol antioxidant is present in said lubricating oil composition in an amount of at least 1.4 wt. %.

9. The engine of claim 6, wherein said lubricating oil composition has at least one of:

(a) a phosphorus content of no more than 0.05 wt. %; and (b) a sulfur content of less than about 1.0 wt. %.

10. The engine of claim 9, wherein said lubricating oil composition has at least one of:

(a) a phosphorus content of from about 0.02 to about 0.05 wt. %; and (b) a sulfur content of less than about 0.06 wt. %.

* * * * *